US006904646B2

(12) United States Patent
Reynolds

(10) Patent No.: US 6,904,646 B2
(45) Date of Patent: Jun. 14, 2005

(54) MULTI-PART CLOSURE DEVICE

(75) Inventor: Gary M. Reynolds, Keller, TX (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/243,595

(22) Filed: Sep. 13, 2002

(65) Prior Publication Data

US 2004/0049891 A1 Mar. 18, 2004

(51) Int. Cl.[7] ..... B65D 77/12

(52) U.S. Cl. ..... 24/30.5 R; 24/543

(58) Field of Search ..... 24/30.5 R, 530, 24/30.5 P, 543, 487; 383/78, 81, 63, 68; 132/278; 606/120

(56) References Cited

U.S. PATENT DOCUMENTS

| | | | | |
|---|---|---|---|---|
| 381,265 | A | | 4/1888 | Martens |
| 1,459,735 | A | | 6/1923 | Kraft |
| 2,589,577 | A | | 3/1952 | Rosenthal et al. |
| 2,898,744 | A | | 8/1959 | Robbins |
| 3,036,506 | A | | 5/1962 | Andresen, Jr. |
| 3,095,291 | A | | 6/1963 | Robbins |
| 3,149,943 | A | | 9/1964 | Amador |
| 3,171,184 | A | | 3/1965 | Posse |
| 3,247,852 | A | | 4/1966 | Schneider |
| 3,259,302 | A | | 7/1966 | Rocchisani |
| 3,461,876 | A | | 8/1969 | Miller, Jr. |
| 3,523,534 | A | | 8/1970 | Nolan |
| 3,542,032 | A | | 11/1970 | Spencer, Jr. |
| 3,551,965 | A | | 1/1971 | Gordon |
| 3,621,539 | A | | 11/1971 | Ayers |
| 3,669,115 | A | | 6/1972 | Melges |
| 3,735,765 | A | | 5/1973 | Ichelson |
| 3,785,111 | A | | 1/1974 | Pike |
| 3,807,118 | A | | 4/1974 | Pike |
| 3,865,117 | A | | 2/1975 | Perry, III |
| 3,874,042 | A | | 4/1975 | Eddleman et al. |
| 3,900,989 | A | * | 8/1975 | Weisenthal ..... 446/222 |
| 3,950,158 | A | | 4/1976 | Gossett |
| 4,038,726 | A | | 8/1977 | Takabayashi |
| 4,057,047 | A | | 11/1977 | Gossett |
| 4,212,303 | A | | 7/1980 | Nolan |
| 4,275,485 | A | | 6/1981 | Hutchison |
| 4,294,582 | A | | 10/1981 | Naslund |
| 4,296,529 | A | | 10/1981 | Brown |
| 4,347,848 | A | | 9/1982 | Hubbard et al. |
| 4,356,599 | A | | 11/1982 | Larson et al. |
| 4,385,950 | A | | 5/1983 | Hubbard et al. |
| 4,397,315 | A | | 8/1983 | Patel |
| 4,416,038 | A | | 11/1983 | Morrone, III |

(Continued)

FOREIGN PATENT DOCUMENTS

| | | | | |
|---|---|---|---|---|
| DE | 9401613 | | 3/1994 | |
| DE | 29916111 | | 9/1998 | |
| EP | 1169984 | A1 | 1/2002 | |
| JP | 63-67262 | | 3/1988 | |
| JP | 10-236487 | | 9/1998 | |
| WO | WO 9818991 | A1 * | 5/1998 | ..... D06F/55/02 |
| WO | WO99/52779 | | 10/1999 | |
| WO | WO 03/029092 | A1 | 4/2003 | |

OTHER PUBLICATIONS

Abstract, JP 10–236487A, Sep. 8, 1998.

*Primary Examiner*—James R. Brittain
(74) *Attorney, Agent, or Firm*—Scott B. Garrison

(57) ABSTRACT

The invention relates to a multi-part closure device or clip having a first and a second clip body component. The clip has a releasable latch at one end, a rigid connection at an opposite end, and at least one flexible neck disposed between the releasable latch and the rigid connection. The flexible neck hinges one clip body component with respect to the other clip body component while enabling the rigid connection to remain stationary with respect to both clip body components.

20 Claims, 6 Drawing Sheets

U.S. PATENT DOCUMENTS 4,427,010 A 1/1984 Marx
4,462,224 A 7/1984 Dunshee et al.
D276,596 S 12/1984 Kisha
4,506,689 A * 3/1985 Fiddler ..... 135/133
4,523,353 A 6/1985 Hubbard et al.
4,551,888 A * 11/1985 Beecher ..... 24/30.5 P
4,636,391 A 1/1987 Pike
4,668,564 A 5/1987 Orchard
4,688,564 A 8/1987 Kelly
4,709,398 A 11/1987 Ausnit
4,753,489 A 6/1988 Mochizuki
4,765,767 A * 8/1988 Marynissen et al. ..... 401/213
4,834,730 A 5/1989 Holtermann et al.
4,854,760 A 8/1989 Pike et al.
4,887,335 A 12/1989 Folkmar
4,896,685 A * 1/1990 Lawrence ..... 132/278
4,953,550 A 9/1990 Dunshee
4,983,172 A 1/1991 Steer et al.
5,008,980 A 4/1991 Zimmermann
5,050,272 A 9/1991 Robinson et al.
5,125,133 A 6/1992 Morrison
5,356,426 A 10/1994 Delk et al.
5,375,300 A 12/1994 Chen
5,379,489 A 1/1995 Delk et al.
5,384,935 A * 1/1995 Maier-Hunke et al. ..... 24/67 R
5,390,473 A 2/1995 Nelson et al.
5,428,871 A 7/1995 Iosif
5,466,251 A 11/1995 Brunson et al.
5,537,724 A * 7/1996 Chou ..... 24/530
5,542,766 A * 8/1996 Cadwallader ..... 383/63
5,604,959 A 2/1997 Bowen
5,619,775 A 4/1997 Klinck
5,713,108 A 2/1998 Solomon et al.
5,735,022 A 4/1998 Niedecker
6,158,095 A * 12/2000 Lassiter ..... 24/339
6,298,526 B1 10/2001 Baumdicker et al.
6,517,473 B1 2/2003 Cappel
6,526,726 B1 3/2003 Strand et al.
2002/0133916 A1 9/2002 Folkmar

* cited by examiner

MULTI-PART CLOSURE DEVICE

BACKGROUND

The present invention relates to a multi-part closure device such as an ice pack clip for releasably sealing ice packs and similar flexible open-ended containers.

It is known to seal ice packs used for a variety of purposes with ice pack clips which are generally of the blade and trough (or sheath) type. The known devices generally include a hinge at one end connecting the blade and the trough and a latch at the other end for releasably closing the clip to seal a bag which passes between the trough and the blade when the clip is closed. Similar clips or clamps are also suitable for a variety of other purposes, including ostomy bags, umbilical cord clamps, etc.

Depending upon the type of clip or clamp chosen, there are shortcomings. For instance, some clips presently used with ice packs consist of a one-piece construction having a blade portion and a trough portion pivotally connected by a hinge. This construction is not easily adapted to automated sorting and feeding. Due to the inherent flexibility of the hinge, the blade and trough move with respect to one another when the clip is subjected to the vibrations often encountered during automated mechanical sorting processes. This movement makes automated feeding difficult. As a result, currently it is required that these clips be attached to ice packs manually resulting in limited production capacity and requiring human participation in the assembly process.

As such, there exists a need for a clip suitable for use on ice packs, ostomy bags, umbilical cord clamps, etc. that exhibits all the advantages of the presently used clip but lends itself to automated sorting, feeding, and assembly.

SUMMARY OF THE INVENTION

As such, one aspect of the present invention discloses a multi-part closure device including a substantially planar blade and a trough. Each piece has a latch end and a connector end. The trough has a necked portion proximal to the trough connector end. Each of the connector ends are fastened one to the other so as to create a rigid joint between the blade and the trough. This enables the necked portion to form a hinge which in turn enables the trough to hinge at the necked portion. Hinging is accomplished substantially about one axis while the blade and rigid joint remain stationary with respect to the trough.

Another aspect of the present invention provides a multi-part closure device or clip having a first and a second clip body component. The clip also has a releasable latch at one end, a rigid connection at an opposite end, and at least one flexible neck disposed between the releasable latch and the rigid connection. The flexible neck hinges one clip body component with respect to the other clip body component while enabling the rigid connection to remain stationary.

Another aspect of the present invention provides a multi-part closure device having a first and a second clip body component each having a connecting portion. A flexible neck is disposed upon at least one of the clip body components proximate to the connecting portion. The flexible neck forms a hinge between the first and second clip body components when the first and second connecting portions are secured one to the other. The first and second connecting portions serve to rigidly connect the two clip body components one to the other at a rigid connection while allowing each clip body component having a flexible neck disposed thereon to move with respect to the other clip body component and the rigid connection.

Still another aspect of the present invention provides a multi-part closure device having a first and second clip body component. The second clip body component is securely fastened to the first clip body component at a rigid connection. At least one flexible region is disposed proximate to the rigid connection. The flexible region serves to enable at least one clip body component to hinge with respect to the rigid connection.

In yet another aspect of the present invention a multi-part closure device is disclosed. The device includes a first and a second clip body component. Each clip body component terminates in a releasable latch end and a rigid connection end. A flexible neck is disposed upon at least one clip body component proximal to the rigid connection end. The flexible neck enables the clip body component upon which it is disposed to hinge about the flexible neck and move with respect to the rigid connection end.

DESCRIPTION OF THE INVENTION

Figure 1:
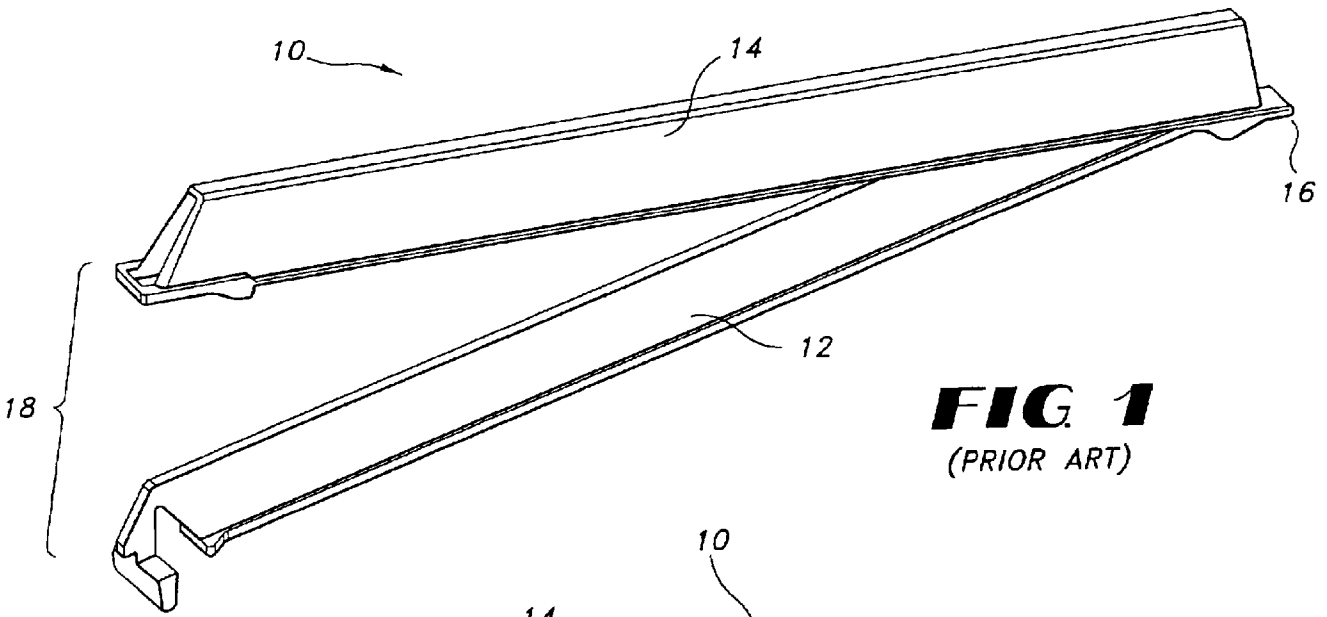
FIG. 1 (PRIOR ART)
FIG. 1 is a side view of an open clip of the prior art design.

The present invention and its advantages are best understood by referring to the drawings, like numerals being used for like and corresponding parts of the various drawings.

Figure 2:
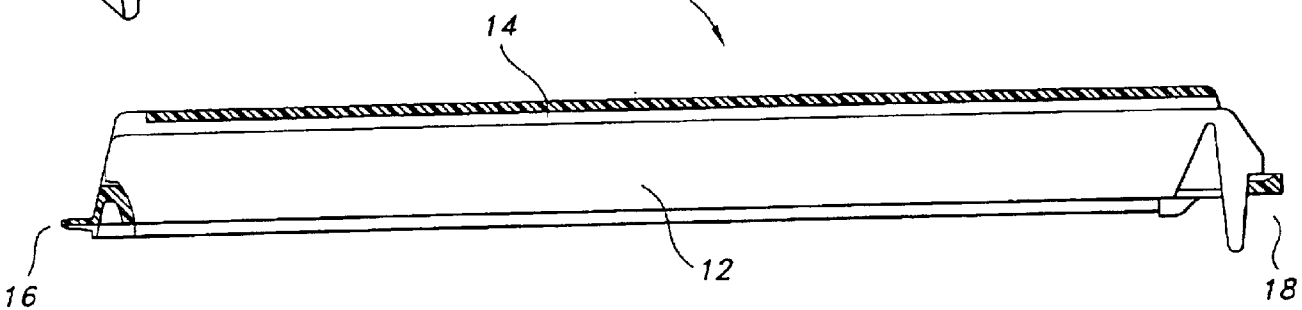
FIG. 2 (PRIOR ART)
FIG. 2 is a side view in partial cutaway of the FIG. 1 prior art design.

Prior art FIGS. 1 and 2 show a clip 10 which in pertinent part is formed of four major components, a substantially planar blade 12, a trough 14, a hinge 16, and a latching mechanism 18. The blade 12 is designed to fit within the trough 14 such that when a bag (not shown) is interposed between the closed blade 12 and the trough 14, the blade 12 and trough 14 cooperate to effectively seal the bag. The blade 12 and trough 14 are designed to be manufactured as a single unit and remain connected via the hinge 16. The hinge commonly used is preferably a strap-like hinge, known in the art as a "living hinge". The present invention eliminates this living hinge 16 and substitutes a new configuration.

Figure 3:
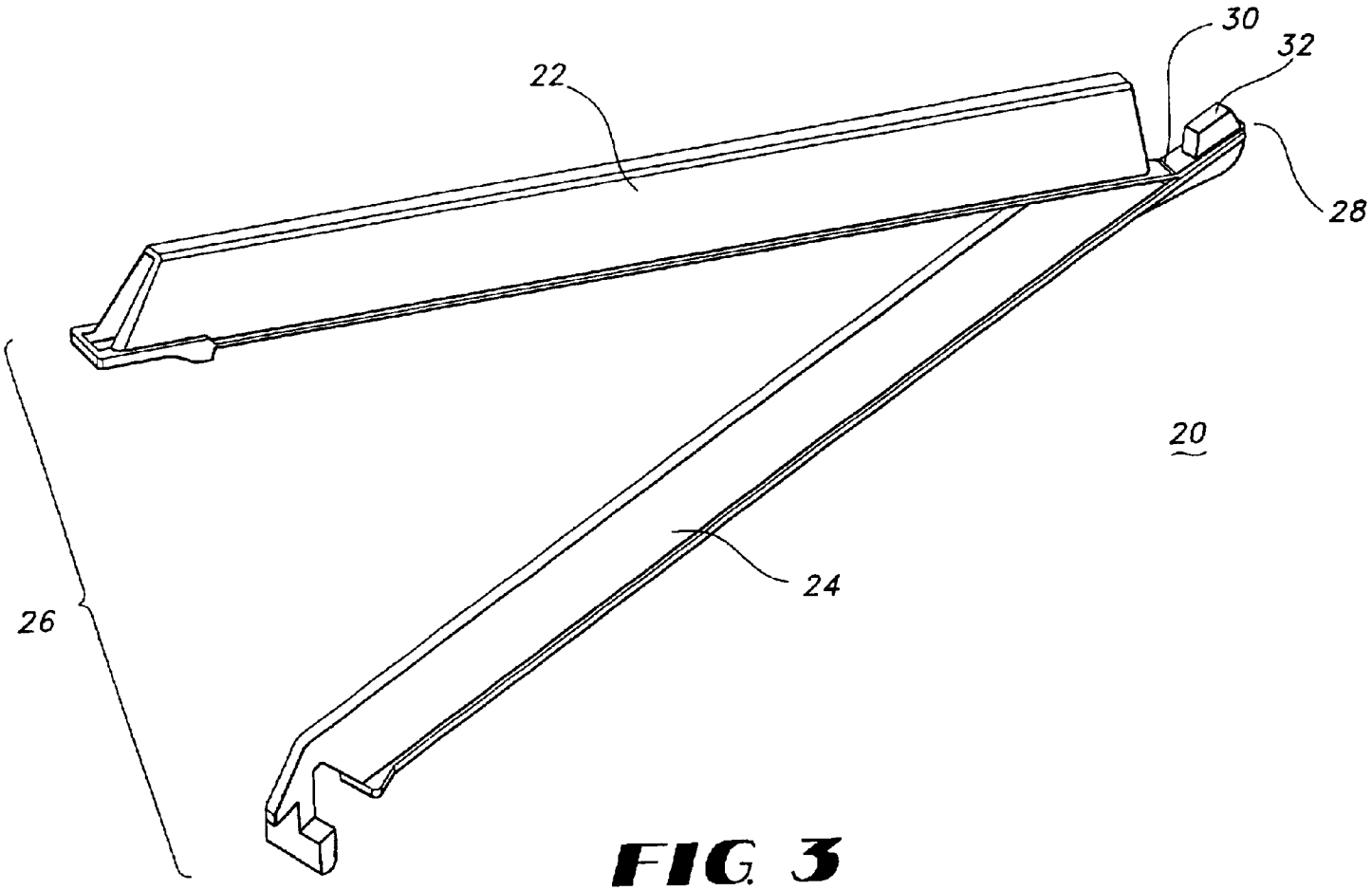
FIG. 3 is a side view of an open clip of the present invention.

In the present invention, shown in FIG. 3, a new clip 20 is depicted. The clip 20 is manufactured as two separate components or clip body components 22 and 24. The clip body components 22 and 24 may be configured similarly to the trough and hinge arrangement disclosed in U.S. Pat. No. 5,604,959, which is fully incorporated herein by reference. However, in the present invention, it is not until the two portions 22, 24 are attached one to the other, that the clip 20 itself is ultimately formed.

Looking to FIG. 3, it can be seen that each clip body component 22, 24 is provided with a portion of a latch or latching mechanism 26 and a blade connector end, also referred to as a connecting end, or connecting portion 28. The specific design of the latching mechanism 26 is not critical to the invention and therefore the mechanism 26 may be configured similar to that disclosed in U.S. Pat. No. 5,604,959.

Proximate to the connecting portion 28 of at least one of the clip body components 22, 24 is a necked portion or necked region 30. The necked region 30 is sufficiently thin and flexible enough to enable the clip body component 22 or 24 upon which it is located to hinge at the necked region 30 once the clip 20 is assembled. As shown in FIG. 3, this necked region 30 effectively allows the clip 20 to open and close enabling movement between a latched and an unlatched position. Formation of the clip 20 is accomplished when the connecting portions 28 of each clip body component 22 and 24 are fastened in some manner to one another resulting in the creation of a rigid configuration or connection 32.

To better enable the necked region 30 to hinge properly at the rigid connection 32, the components 22 and 24 may be constructed so as to possess added thickness and rigidity at the connecting portions 28. Further, the necked region 30 may be made sufficiently thin so as to flexibly hinge between the connecting portion 28 and the remainder of the clip body component 22 and/or 24. This arrangement moves the latching mechanism 28 toward and away from a clip open and a clip closed position allowing a bag (not shown) to be captured between the clip body components 22 and 24.

Figure 6:
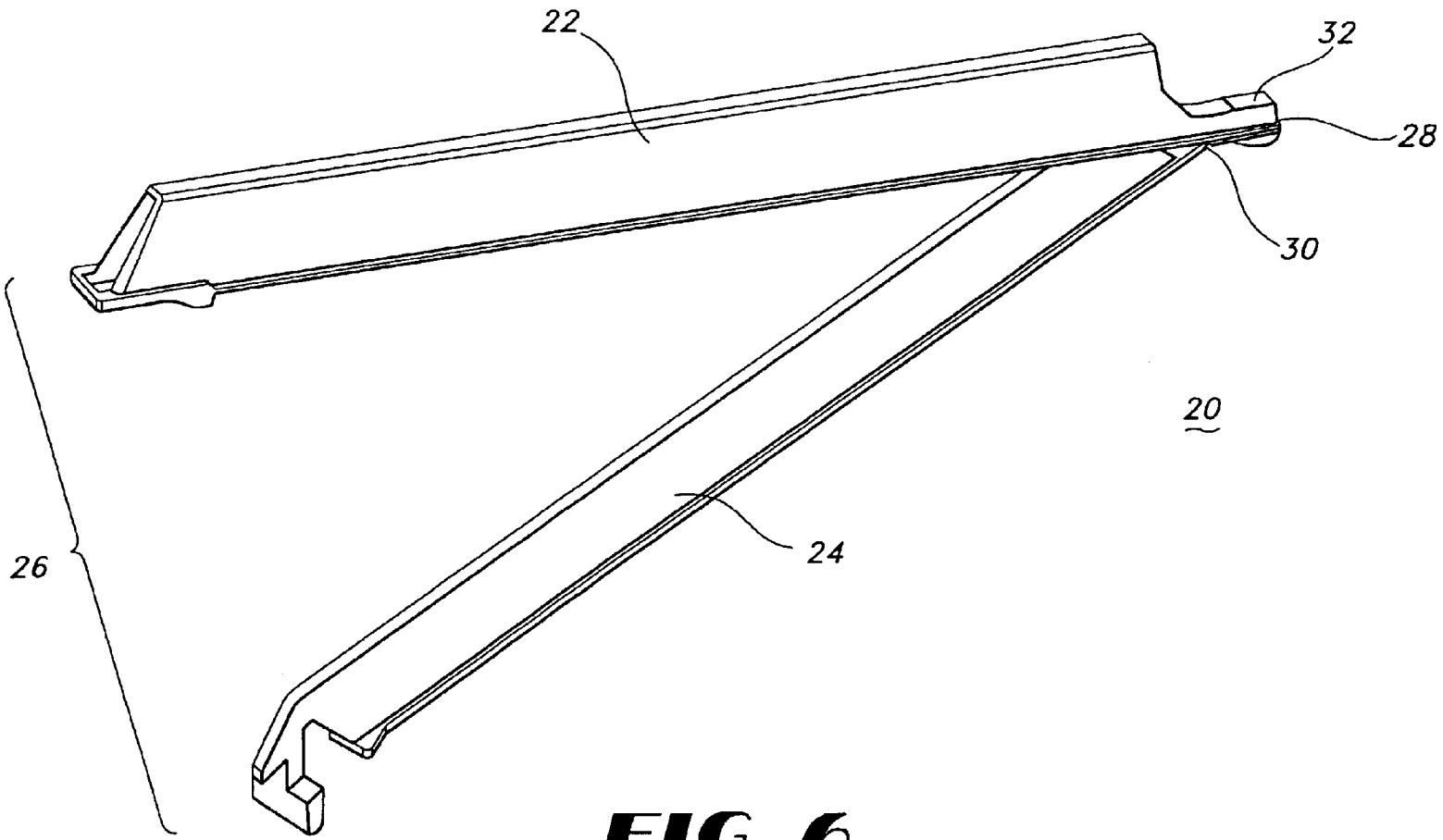
FIG. 6 is a side view of an alternative embodiment of the FIG. 3 open clip of the present invention.
Figure 7:
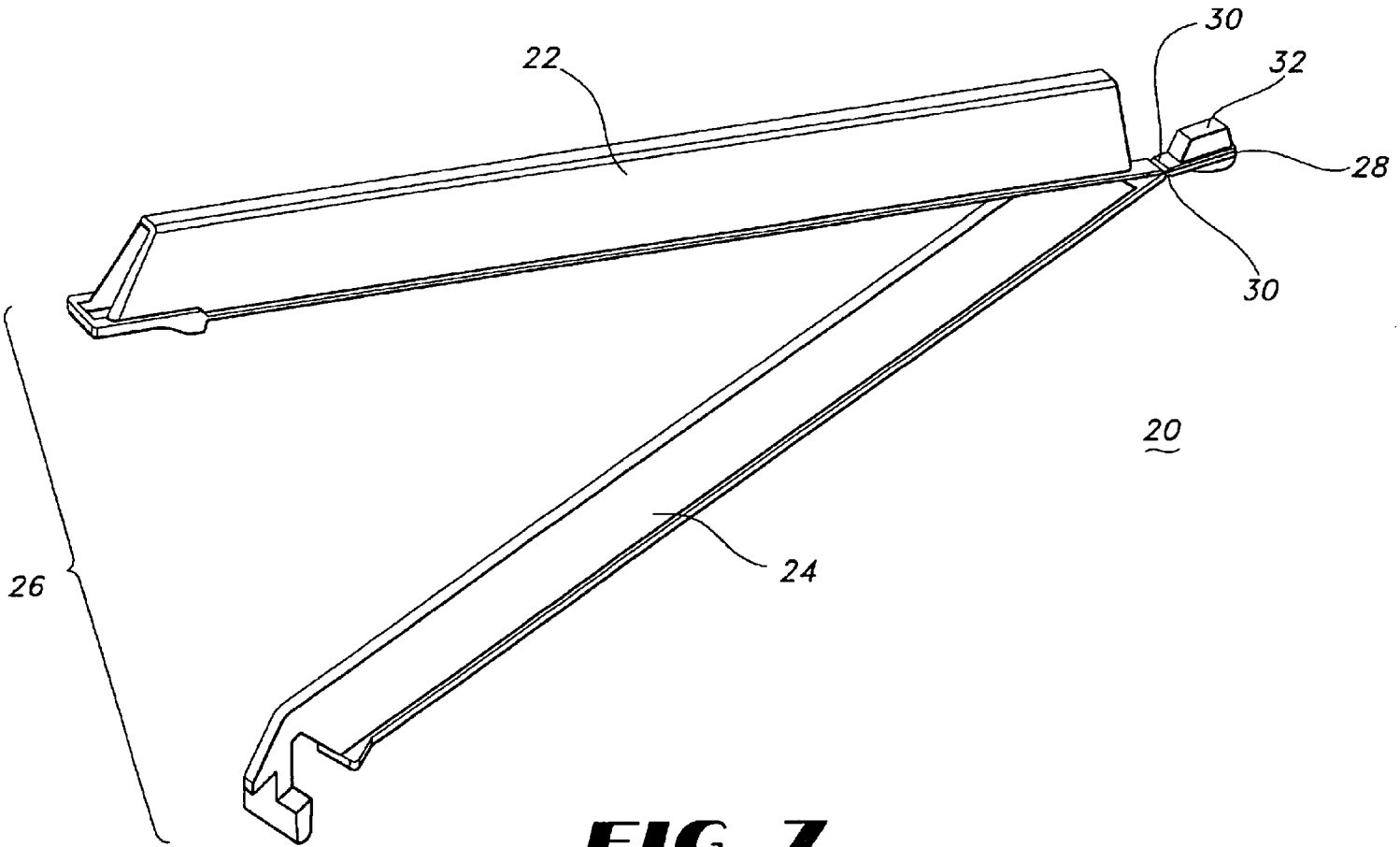
FIG. 7 is a side view of an alternative embodiment of the FIG. 3 open clip of the present invention.

More specifically, the necked region 30 permits the clip body component 22 having the necked region to hinge with respect to the other clip body component and the rigid connection 32. Although the necked region 30 is depicted as being on clip body component 22, it may alternatively be located on clip body component 24 as depicted in FIG. 6. Other embodiments, such as that depicted in FIG. 7, may include providing at least one necked region 30 on each clip body component 22 and 24. This would enable both clip body components 22 and 24 to hinge with respect to each other while the rigid connection 32 remained stationary.

Figure 4:
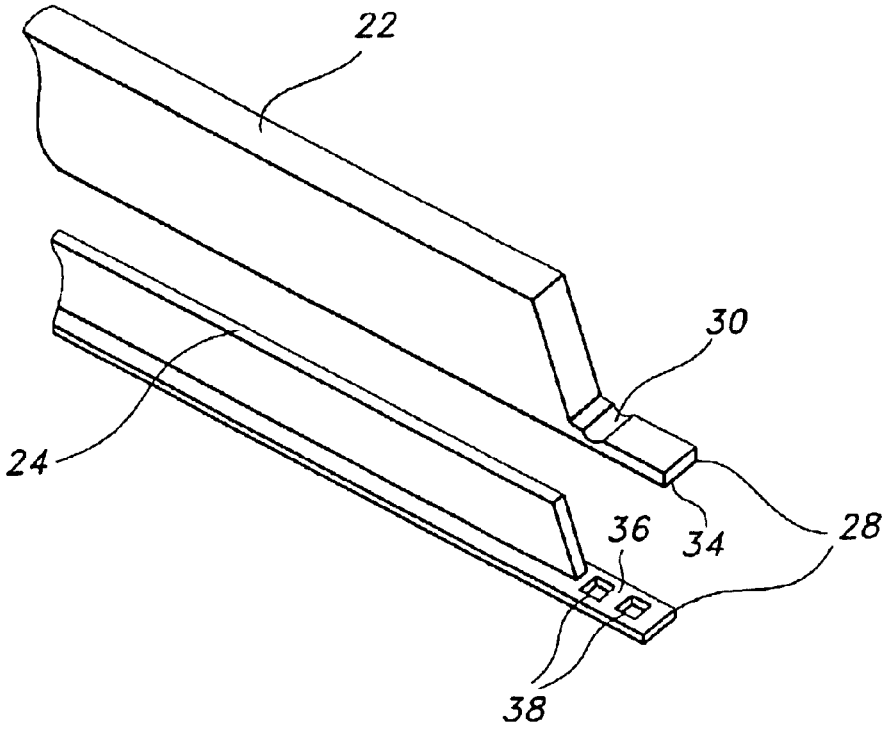
FIG. 4 shows an embodiment of the rigid connection end of the clip of the present invention.

A number of possible alternatives are available to fasten the clip body components 22 and 24 together. In the FIG. 4 embodiment, two surfaces, 34 and 36 are depicted, one at each of the connecting portions 28. These surfaces when joined together form the rigid connection 32. The rigid connection 32 can be made permanent via the application of adhesives, through the use of thermal and/or ultrasonic bonding, etc. It is well known in the art that a typical bond may be configured so as to include raised features (not shown) in order to create a bond concentration. Alignment nibs 38 depicted in the FIG. 4 may also be provided on either or both connecting portions 28 to assist in alignment of the clip body components 22, 24. Alignment nibs 38 may take any number of forms including raised areas and complementary recessed areas and be located on either or both of the surfaces 34 and/or 36.

Figure 5:
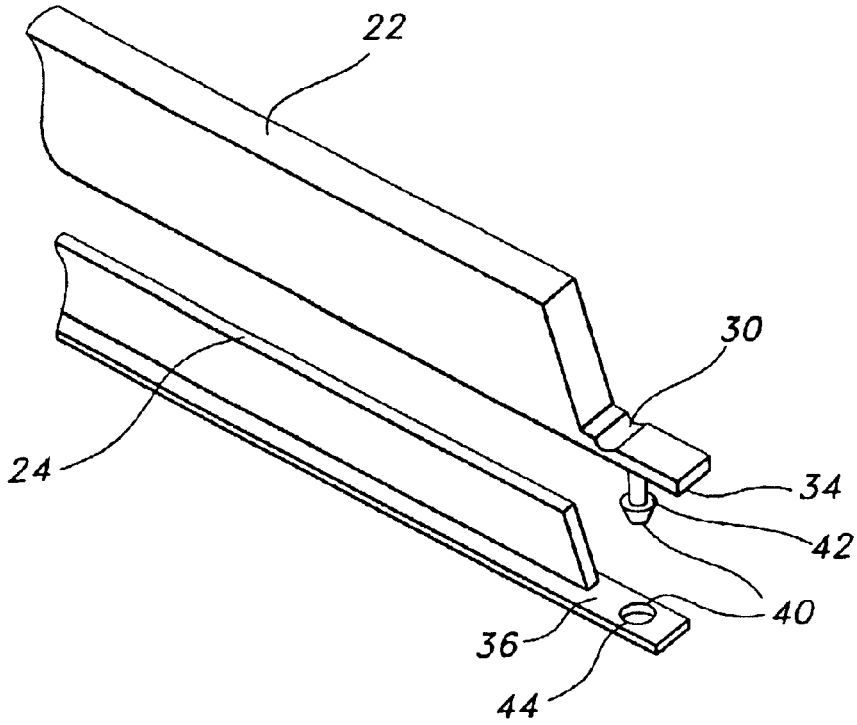
FIG. 5 shows an alternative embodiment of the rigid connection end of the clip of the present invention.

One possible alternative, as shown for example in FIG. 5, provides fasteners 40 which serve to fasten the clip body components 22 and 24 one to the other. Examples of such fasteners 40 may include bayonet-type fasteners as shown having a male portion 42 and a female portion 44, however, post and post aperture arrangements, single and multiple tab and slot arrangements, as well as other male/female type fittings are suitable as well. In general, it is desirable to design the fasteners 40 so that more force is required to separate the connecting portions 28 than is required to unlatch the latch mechanism 26. As such, in some embodiments, the fasteners 40 may be semi-permanently joined. In other embodiments, the fasteners 40 may be permanently joined. Likewise, it should be apparent that it is also desirable to design the fasteners 40 to have sufficient strength to entrap and seal a bag or other material, such as an ice pack, between the body components 22 and 24 so that the material does not leak fluid therefrom.

Although the present invention and its advantages have been described in detail, it should be understood that various changes, substitutions, and alterations can be made therein without departing from the spirit and scope of the invention as defined by the appended claims.

What is claimed is:

1. A multi-part closure device comprising:

a substantially planar blade having a blade latch end and a blade connector end, the blade connector end forming a first part of a bayonet fastener; and a trough having a trough latch end to selectively latch and unlatch to the blade latch end, a trough connector end, and a necked portion proximal to the trough connector end, the trough connector end forming a second part of a bayonet fastener;

wherein the blade and trough are discrete components until the connector ends are fastened one to the other to create a rigid joint between the blade and the trough in the form of a bayonet fastener; and wherein the necked portion forms a hinge enabling the trough to hinge at the necked portion substantially about one axis while the blade and rigid joint remain stationary with respect to the trough.

2. The device of claim 1 wherein the connector ends are permanently joined one to the other.

3. The device of claim 1 wherein the blade comprises a necked portion proximal to the blade connector end.

4. The device of claim 1 wherein the necked portion enables the trough to hinge in substantially one plane about the necked portion.

5. A multi-part closure device comprising a clip having a first and a second discrete clip body component, the clip having a releasable latch at one end, a rigid connection at an opposite end, and at least one flexible neck disposed between the releasable latch and the rigid connection, the flexible neck hinging one clip body component with respect to the other clip body component while enabling the rigid connection to remain stationary with respect to both clip body components, wherein the clip body components are separable at the rigid connection.

6. The device of claim 5 wherein the clip body components are securely interconnected at the rigid connection and releasably interconnected at the releasable latch.

7. The device of claim 5 wherein the rigid connection comprises:

a post aperture disposed upon at least one clip body component; and a corresponding post disposed upon the opposite clip body for engaging the at least one post aperture;

wherein engaging the post with the post aperture rigidly secures the two clip body components one to the other.

8. The device of claim 5 adapted to seal ice packs.

9. The device of claim 5 comprising a flexible neck on each clip body component disposed between the releasable latch and the rigid connection.

10. A multi-part closure device comprising:

a first discrete clip body component having a first connecting portion;

a second discrete clip body component having a second connecting portion;

a flexible neck disposed upon at least one of the clip body components proximate to the connecting portion, the flexible neck forming a hinge between the first and second dip body components when the first and second connecting portions are secured one to the other, the first and second connecting portions rigidly connecting the two clip body components one to the other at a rigid connection while allowing each clip body component having the flexible neck disposed thereon to move with respect to the other clip body component and the rigid connection, wherein the first and second connecting portions are separable at the rigid connection.

11. The device of claim 10 comprising a flexible neck disposed upon each clip body component.

12. The device of claim 10 wherein one of the clip body components comprises a trough and the other clip body component comprises a planar blade.

13. The device of claim 12 wherein the flexible neck is disposed upon the trough thereby enabling the trough to movably hinge about the flexible neck while the rigid connection and the blade remain stationary with respect to one another.

14. The device of claim 12 wherein the flexible neck is disposed upon the blade thereby enabling the blade to movably hinge about the flexible neck while the rigid connection and the trough remain stationary with respect to one another.

15. The device of claim 12 wherein flexible necks are disposed upon both the blade and trough thereby enabling the blade and trough to movably hinge about the flexible neck while the rigid connection remains stationary.

16. A multi-part closure device comprising:

a first and a second clip body component, each clip body component being discrete one from the other and terminating in a releasable latch end and a rigid connection end;

a flexible neck disposed on at least one clip body component proximal to the rigid connection end, the flexible neck enabling the clip body component upon which it is disposed to hinge about the flexible neck and move with respect to the rigid connection end; and alignment nibs disposed between the first and a second clip body components for assisting alignment of the clip body components;

wherein the first and a second clip body component are permanently bonded one to the other.

17. A multi-part closure device comprising:

a substantially planar blade having a blade latch end and a blade connector end; and a trough having a trough latch end to selectively latch and unlatch to the blade latch end, a trough connector end, and a necked portion proximal to the trough connector end;

wherein the blade and trough are discrete components until the connector ends are fastened one to the other by a bayonet fastener to create a rigid joint between the blade and the trough; and wherein the necked portion forms a hinge enabling the trough to hinge at the necked portion substantially about one axis while the blade and rigid joint remain stationary with respect to the trough.

18. A multi-part closure device comprising:

a clip having a first and a second discrete clip body component; the clip further comprising:

a releasable latch at one end, a rigid connection at an opposite end having a post aperture disposed upon at least one clip body component; and a corresponding post disposed upon the opposite clip body for engaging the at least one post aperture; wherein engaging the post with the post aperture rigidly secures the two clip body components one to the other; and at least one flexible neck disposed between the releasable latch and the rigid connection, the flexible neck hinging one clip body component with respect to the other clip body component while enabling the rigid connection to remain stationary with respect to both clip body components, wherein the clip body components are separable at the rigid connection.

19. The device of claim 18 wherein the clip body components are securely interconnected at the rigid connection and releasably interconnected at the releasable latch.

20. The device of claim 18 comprising a flexible neck on each clip body component disposed between the releasable latch and the rigid connection.

* * * * *